US007303513B1

(12) United States Patent
Curtiss

(10) Patent No.: US 7,303,513 B1
(45) Date of Patent: Dec. 4, 2007

(54) THERAPEUTIC REHABILITATIVE APPARATUS

(76) Inventor: Gordon H. Curtiss, 1335 Corley Ct., West Columbia, SC (US) 29070

( * ) Notice: Subject to any disclaimer, the term of this patent is extended or adjusted under 35 U.S.C. 154(b) by 199 days.

(21) Appl. No.: 11/026,178

(22) Filed: Dec. 30, 2004

Related U.S. Application Data

(60) Provisional application No. 60/533,522, filed on Jan. 2, 2004.

(51) Int. Cl.
*A63B 21/04* (2006.01)

(52) U.S. Cl. ..... 482/130; 482/904

(58) Field of Classification Search ..... 482/904, 482/60, 63, 131, 91, 905, 95, 96, 130; 601/27, 601/33, 34
See application file for complete search history.

(56) References Cited

U.S. PATENT DOCUMENTS 2,855,199 A * 10/1958 Noland et al. ..... 482/97
3,000,632 A * 9/1961 Fuchs ..... 482/97
3,103,357 A * 9/1963 Berne ..... 482/118
3,285,070 A * 11/1966 McDonough ..... 73/379.01
4,407,496 A * 10/1983 Johnson ..... 482/97
4,502,681 A * 3/1985 Blomqvist ..... 482/130
4,641,833 A * 2/1987 Trethewey ..... 482/95
4,784,121 A * 11/1988 Brooks ..... 601/34
5,327,558 A * 7/1994 Burke et al. ..... 710/8
5,407,414 A * 4/1995 Bass ..... 482/129
5,662,591 A * 9/1997 Peindl et al. ..... 601/24
5,800,323 A * 9/1998 Ansel ..... 482/129
5,913,752 A * 6/1999 Bolf ..... 482/72
6,261,212 B1 * 7/2001 Vallone et al. ..... 482/120

* cited by examiner

*Primary Examiner*—Stephen R. Crow
*Assistant Examiner*—Allana Lewin
(74) *Attorney, Agent, or Firm*—John D. Gugliotta, PE, Esq.

(57) ABSTRACT

A therapeutic rehabilitative apparatus is provided. The therapeutic rehabilitative apparatus is adapted to be removably attached to a standard chair or standard wheelchair in order to provide user with a means for providing physical therapy to a medically afflicted knee. The apparatus includes a bracket adapted to engage the seat portion of the standard chair. The bracket includes a fulcrum pin connector to which a lever is rotationally mounted. A tightener mechanism tightly secures the bracket against the outer ledge portion of the standard chair. The lever includes a handle mounted to an upper end and a rotatable pedal mounted to a lower end.

12 Claims, 9 Drawing Sheets

THERAPEUTIC REHABILITATIVE APPARATUS

RELATED APPLICATIONS

This application claims the benefit of U.S. Provisional Application No. 60/533,522 filed on Jan. 2, 2004.

BACKGROUND OF THE INVENTION

1. Field of the Invention

The present invention relates generally to physical therapy and, more particularly, to a therapeutic rehabilitative apparatus.

2. Description of the Related Art

Treating health problems through physical therapy have been known for many years. Before World War I, few people were aware of or had any knowledge of physical therapy. Physical therapy's real worth was not recognized until World War II when medical teams in the armed forces successfully rehabilitated seriously injured patients. Their success induced more people in the medical field to appreciate the benefits that physical therapy could provide.

Physical therapy treatment is provided through various forms of treatment including heat, light, and sound treatments, massages, and exercises targeted to help heal muscles, nerves, bones, and joints. Regarding exercises, many devices have been developed to facilitate rehabilitation of joint-related injuries and trauma. However, none of these devices have taught an apparatus adapted for use with a standard chair or a standard wheelchair.

Accordingly, there exists a need for a therapeutic rehabilitative apparatus adapted for use with a standard chair or a standard wheelchair which facilitates selectively-adjustable resistance by the user, so as to allow the engaged resistance to be increased or decreased at any time during a rehabilitation cycle according to user preference. The development of the therapeutic rehabilitative apparatus fulfills this need.

SUMMARY OF THE INVENTION

Therefore, it is an object of the present invention to provide a therapeutic rehabilitative apparatus adapted to be utilized with standard chair or a standard wheelchair.

It is another object of the present invention to provide a bracket adapted to engage an outer ledge portion of the seat portion of a standard chair.

It is another object of the present invention to provide a tightener mechanism for tightly securing bracket against the outer ledge portion of the seat portion of the standard chair.

It is another object of the present invention to provide a lever having a handle mounted at one end and a rotatable pedal or foot-rest mounted at an opposite end.

It is another object of the present invention to provide a fulcrum about which lever rotates.

It is another object of the present invention to provide a lever having a fulcrum pin mounted approximately intermediate to the handle and the pedal.

It is another object of the present invention to provide a lever having a fulcrum pin adapted for insertion through a circular bore of a fulcrum pin connector, thereby facilitating rotational mounting of the lever to the fulcrum pin connector.

Briefly described according to one embodiment of the present invention, a therapeutic rehabilitative apparatus is provided. The therapeutic rehabilitative apparatus is adapted to be utilized with standard chair or a standard wheelchair. The therapeutic rehabilitative apparatus is designed and configured for removable attachment to a seat portion of a standard chair, and provides user with a means for providing physical therapy to a medically afflicted knee in a manner which is quick, easy, and efficient.

The therapeutic rehabilitative apparatus comprises a bracket adapted to engage an outer ledge portion of the seat portion of the standard chair. The bracket includes a fulcrum pin connector mounted to a lower end thereof. The fulcrum pin connector includes a circular bore throughwhich a fulcrum pin of a lever is inserted.

A tightener mechanism is provided for tightly securing bracket against the outer ledge portion of the seat portion of the standard chair. The tightener mechanism comprises a flexible, elongated band which is tautened around seat portion via a tension means or a clamping device which resembles a "C" clamp.

The lever is comprised of an elongated member having an anterior end opposing a posterior end, and a front surface opposing a rear surface. The anterior end includes an aperture formed therein for perpendicularly mounting a handle. The posterior end is provided with a pedal or foot-rest which is adapted to rotate about an axle. An end of axle is provided with threads adapted to mate with a threaded aperture formed at the posterior end of lever.

Mounted approximately intermediate to handle and pedal projects the fulcrum pin. The fulcrum pin is inserted through the circular bore of fulcrum pin connector, thereby rotationally mounting lever to fulcrum pin connector. The connection of fulcrum pin with pin connector provides a fulcrum about which lever rotates.

The use of the present invention allows a therapeutic rehabilitative apparatus to be utilized with a standard chair or a standard wheelchair which facilitates selectively-adjustable resistance by the user, so as to allow the engaged resistance to be increased or decreased at any time during a rehabilitation cycle according to user preference.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENT

1. Detailed Description of the Figures

Referring now to FIGS. 1-6, a therapeutic rehabilitative apparatus 10 is shown, according to the present invention, adapted to be utilized with standard chair 12 or a standard wheelchair. The therapeutic rehabilitative apparatus 10 is designed and configured for removable attachment to a seat portion 14 of a standard chair 12. The therapeutic rehabilitative apparatus 10 provides user with a means for providing physical therapy to a medically afflicted knee in a manner which is quick, easy, and efficient.

Figure 2:
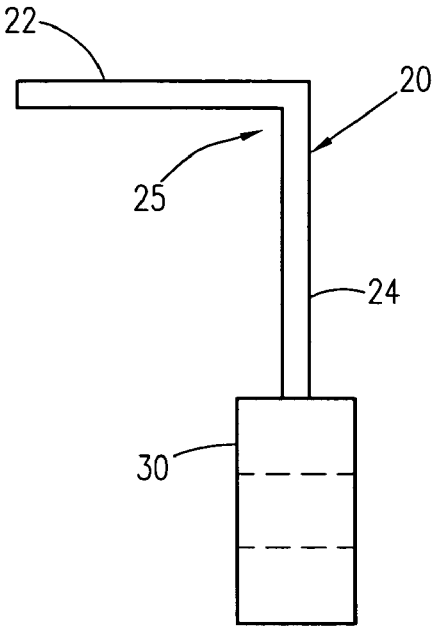
FIG. 2 is a right side elevational view of the bracket, according to the preferred embodiment of the present invention.
Figure 2A:
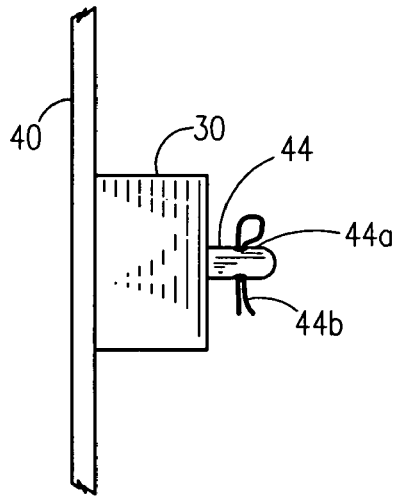
FIG. 2*a* is a side elevational view illustrating the use of a cotter pin for holding the fulcrum pin or lever in rotational connection within the circular bore of fulcrum pin connector.
Figure 3:
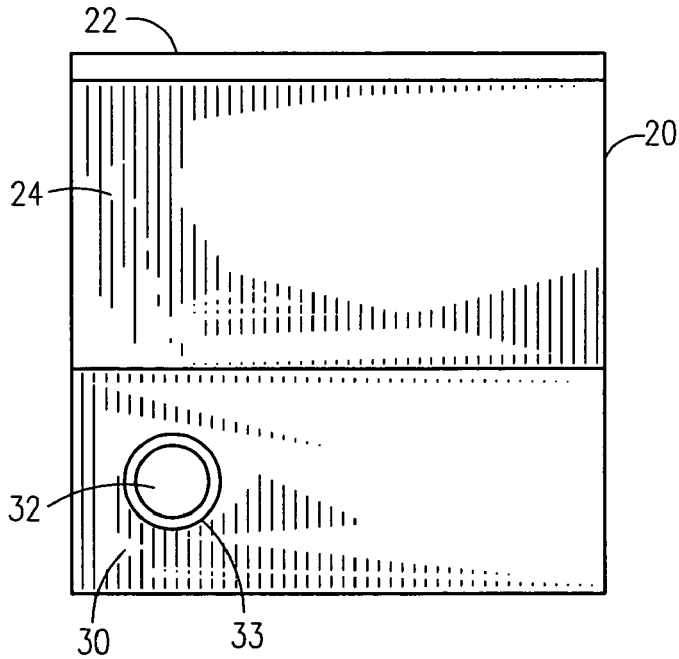
FIG. 3 is a front side view of the bracket and fulcrum pin connector, according to the preferred embodiment of the present invention.
Figure 6:
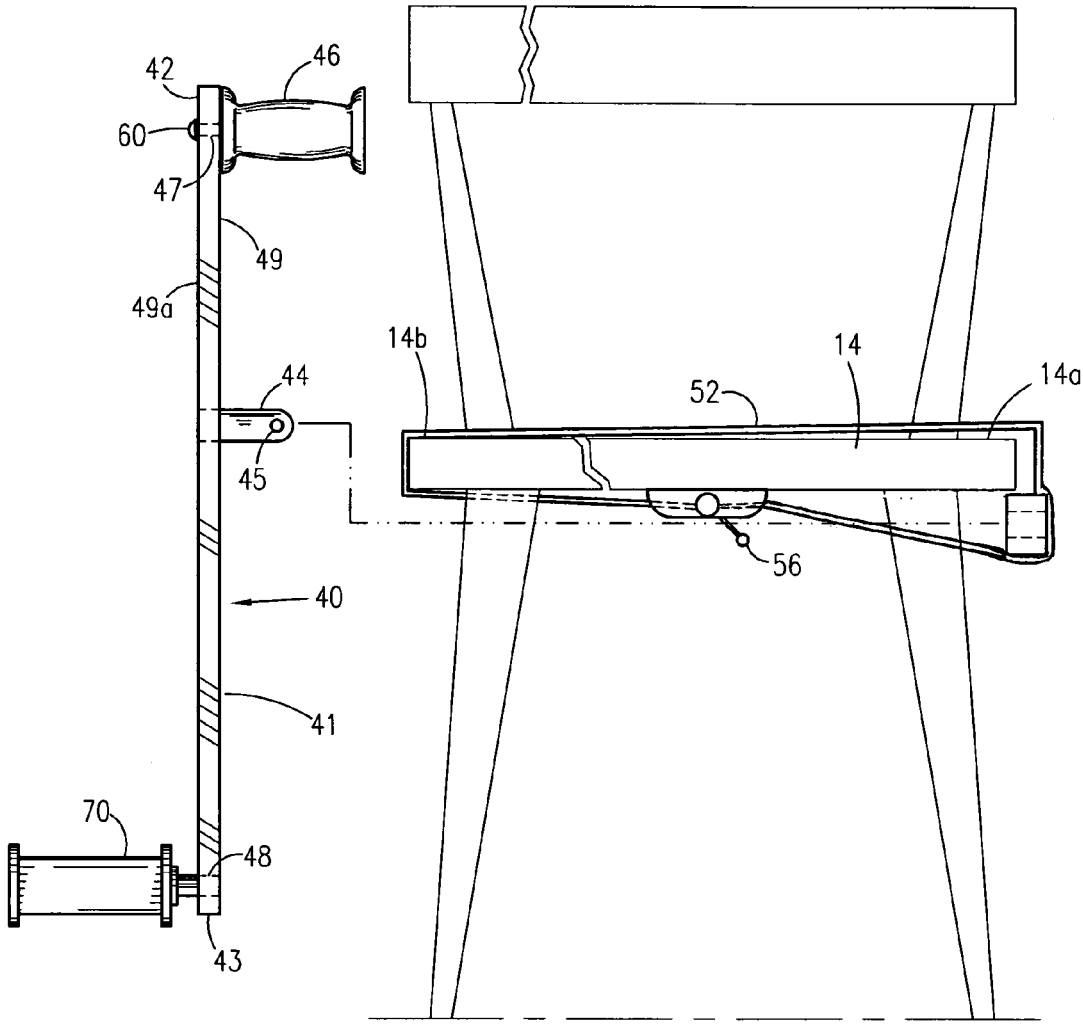
FIG. 6 is an exploded perspective view showing attachment of lever to fulcrum pin connector, according to the preferred embodiment of the present invention.

Referring more specifically to FIGS. 2, 3, and 6, the therapeutic rehabilitative apparatus 10 comprises a bracket 20 adapted to engage an outer ledge portion 14*a* of the seat portion 14 of the standard chair 12. For illustrative purposes, the bracket 20 is shown engaged against a left side outer ledge portion 14*a*, however, bracket 20 is configured so as to allow for engagement against a right side outer ledge portion 14*b* as well. The bracket 20 defines a generally L-shaped configuration having a horizontal upper member 22 integrally joined to a vertical member 24. Horizontal upper member 22 and vertical member 24 form an inner cavity 25 adapted to receive the outer ledge portion 14*a* of the standard chair 12 in a snug manner. Horizontal upper member 22 and vertical member 24 include inner sidewalls which form a seat portion engagement surface 26 adapted to snugly envelope the outer ledge portion 14. The bracket 20 is envisioned as being fabricated of angle material including but not limited to metal, rigid plastic, and wood. Bracket 20 is alternatively envisioned as being fabricated of flat stock material.

The bracket 20 further defines a fulcrum pin connector 30 mounted to a lower end of vertical member 24. The fulcrum pin connector 30 includes a circular bore 32 throughwhich a fulcrum pin 44 of a lever 40 is inserted (to be described later in greater detail). The circular bore 32 is formed proximal to a lateral sidewall of fulcrum pin connector 30. The circular bore 32 of fulcrum pin connector 30 is adapted with a bearing 33 to facilitate frictionless rotation by the fulcrum pin 44.

Figure 1:
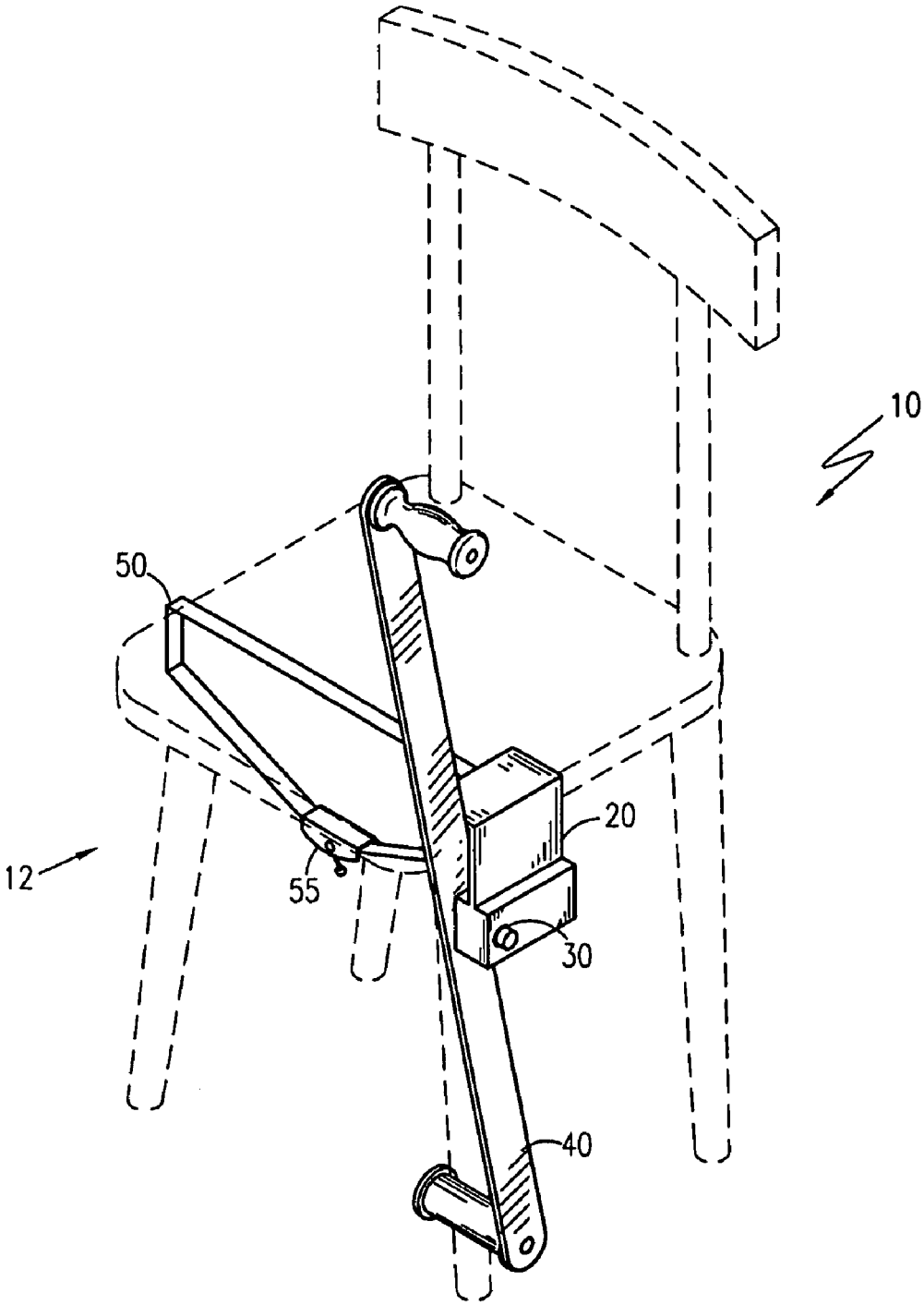
FIG. 1 is a perspective view of a therapeutic rehabilitative apparatus, according to the preferred embodiment of the present invention.
Figure 4:
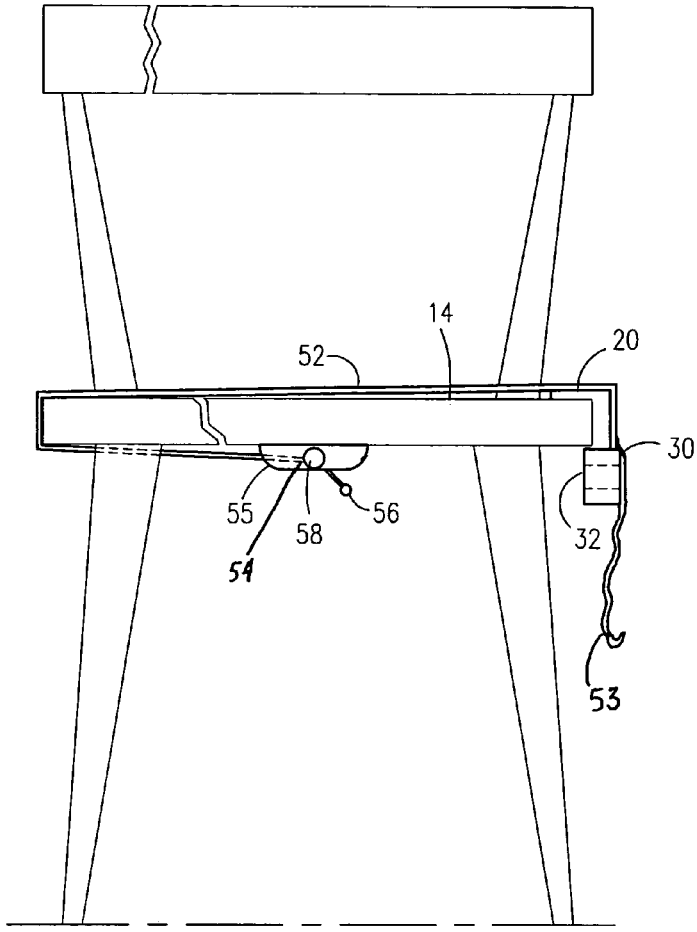
FIG. 4 is a front side elevational view of the present invention illustrating attachment of the bracket to the seat portion of a standard chair, according to the preferred embodiment thereof.
Figure 5:
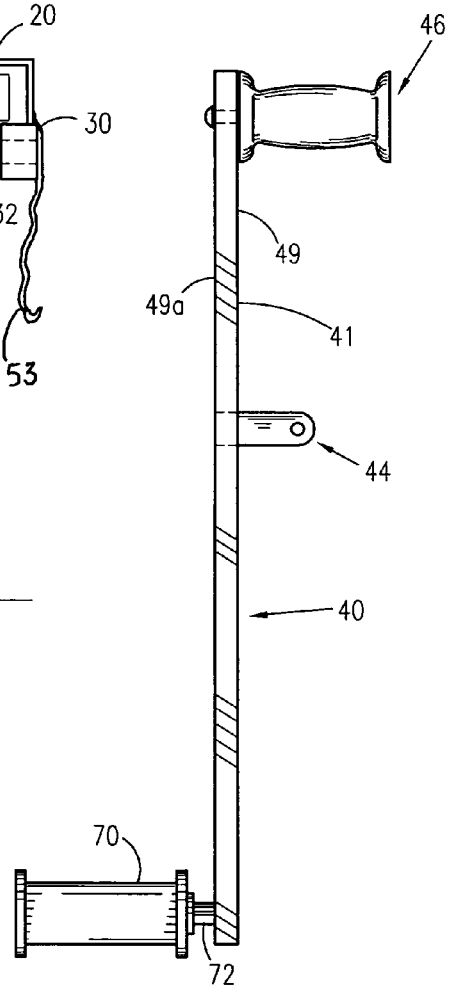
FIG. 5 is a side elevational view of the lever.

Referring now to FIGS. 1, 3, and 4, the tightener mechanism 50 is adapted to tightly secure bracket 20 against an outer ledge portion 14*a* of the seat portion 14 of a standard chair 12. The tightener mechanism 50 comprises a flexible, elongated band 52 having a free end 53 which is directed around an entire seat portion 14 of the standard chair 12, and over and around an outer surface of bracket 20 and fulcrum pin connector 30 after proper engagement of bracket 20 against an outer ledge portion 14*a* of the seat portion 14 of the standard chair 12. The flexible, elongated band 52 is wrapped around the entire periphery of seat portion 14 of the standard chair 12 in a manner so as to surround and envelope the seat portion 14. The free end 53 of flexible, elongated band 52 is then removably coupled to a tension means 55, wherein tension means 55 is also connected to an opposing end 54 of flexible, elongated band 52. The flexible, elongated band 52 is tautened around seat portion 14 utilizing the tension means 55. The tension means 55 includes a handle 56 adapted to provide ratchet action upon pivotal reciprocation thereof so as to allow for the flexible, elongated band 52 to be tightened around seat portion 14, and which in turn tightly secures bracket 20 in position. The tension means 55 is envisioned to include a tension release mechanism 58 adapted to relax flexible, elongated band 52 in order to facilitate its easy removal from seat portion 14.

Referring now to FIGS. 1, 3 and 4-6, the lever 40 is comprised of an elongated member 41 having an anterior end 42 opposing a posterior end 43, and a front surface 49 opposing a rear surface 49*a*. The anterior end 42 includes an aperture 47 formed therein for perpendicularly mounting a handle 46 via a fastener 60. The handle 46 projects perpendicularly from the front surface 49 of elongated member 41. The posterior end 43 is provided with a pedal 70 or foot-rest. A threaded aperture 48 is formed at the posterior end 43 and is adapted to threadedly mount the pedal 70. The pedal 70 is adapted to rotate about an axle 72. An end of axle 72 is provided with threads adapted to mate with a threaded aperture 48 formed at the posterior end 43 of lever 40. The pedal 70 projects perpendicularly from the rear surface 49*a* of elongated member 41.

Mounted approximately intermediate to handle 46 and pedal 70 projects a fulcrum pin 44. The fulcrum pin 44 projects perpendicularly from the front surface 49 of elongated member 41. As described above, the fulcrum pin 44 is inserted through the circular bore 32 of fulcrum pin connector 30, thereby rotationally mounting lever 40 to fulcrum pin connector 30. The circular bore 32 of fulcrum pin connector 30 is adapted with a bearing 33 to facilitate frictionless rotation by the fulcrum pin 44. The fulcrum pin 44 is provided with a detent 45 for holding pin 44 in rotational connection within circular bore 32. Alternatively, fulcrum pin 44 is provided with an aperture 44*a* extending therethrough for accepting a cotter pin 44*b* or industrial hair pin for holding pin 44 in rotational connection within circular bore 32. Thus, the connection of fulcrum pin 44 with pin connector 30 provides a fulcrum about which lever 40 rotates.

Before describing proper operation of the present invention, particular physical therapy functional movements are described herein. A "leg extension" movement is performed by engaging user's rearward ankle portion against pedal 70 or foot-rest and contracting the quadricep (thigh) muscles of the leg and lifting the leg to a near horizontal position in a slow, controlled manner, while simultaneously pulling the handle 46 of lever 40 backward with hand using an amount of force as is necessarily required. Next, the leg is lowered in a slow, controlled manner to the floor to a position which leaves upper thigh and lower thigh in a generally right angle orientation. Repeat the aforementioned steps for a number of repetitions and for a number of sets. Alternatively, user may rest foot atop pedal 70 or foot-rest and perform the "leg extension" movement as described above. A "leg curl" movement is performed by engaging user's forward ankle portion against pedal 70 or foot-rest, and with hand grasping handle 46 of lever 40, contracting the biceps femoris (hamstring) muscles of the leg and pulling the leg downward to a generally right angle orientation in a slow, controlled manner, while simultaneously pushing the handle 46 of lever 40 forward with hand using an amount of force as is necessarily required. Next the leg is raised in a slow, controlled manner to a nearly horizontal position. Repeat the aforementioned steps for a number of repetitions and for a number of sets. Alternatively, user may rest foot atop pedal 70 or foot-rest and perform the "leg curl" movement as described above.

Thus, in order to facilitate therapeutic rehabilitation through the performance of the "leg extension" movement, user sits atop the seat portion 14 of the standard chair 12, engages and maintains contact by user's rearward ankle portion or user's foot firmly in contact with pedal 70 or foot-rest, and with hand grasping handle 46 of lever 40, user extends then lowers accompanying leg while simultaneously pulling handle 46 of lever 40 backward in an adjustable-resistant, sequential manner, wherein resistance being operatively and appropriately controlled in a conjunctive manner by amount of force applied or lessened by user's manual operation of lever 40.

In order to facilitate therapeutic rehabilitation through the performance of the "leg curl" movement, user sits atop the seat portion 14 of the standard chair 12, engages and maintains contact by user's forward ankle portion or user's foot firmly in contact with pedal 70, and with hand grasping handle 46 of lever 40, user pushes lever 40 forward and bends accompanying leg downward and then extends leg in an adjustable-resistant, sequential manner, wherein resistance being operatively and appropriately controlled in a conjunctive manner by amount of force applied or lessened by user's manual operation of lever 40.

The design and configuration of the lever 40 and pedal 70 facilitate selectively-adjustable resistance by the user, so as to allow the engaged resistance to be increased or decreased at any time during a rehabilitation cycle according to user preference.

Figure 7:
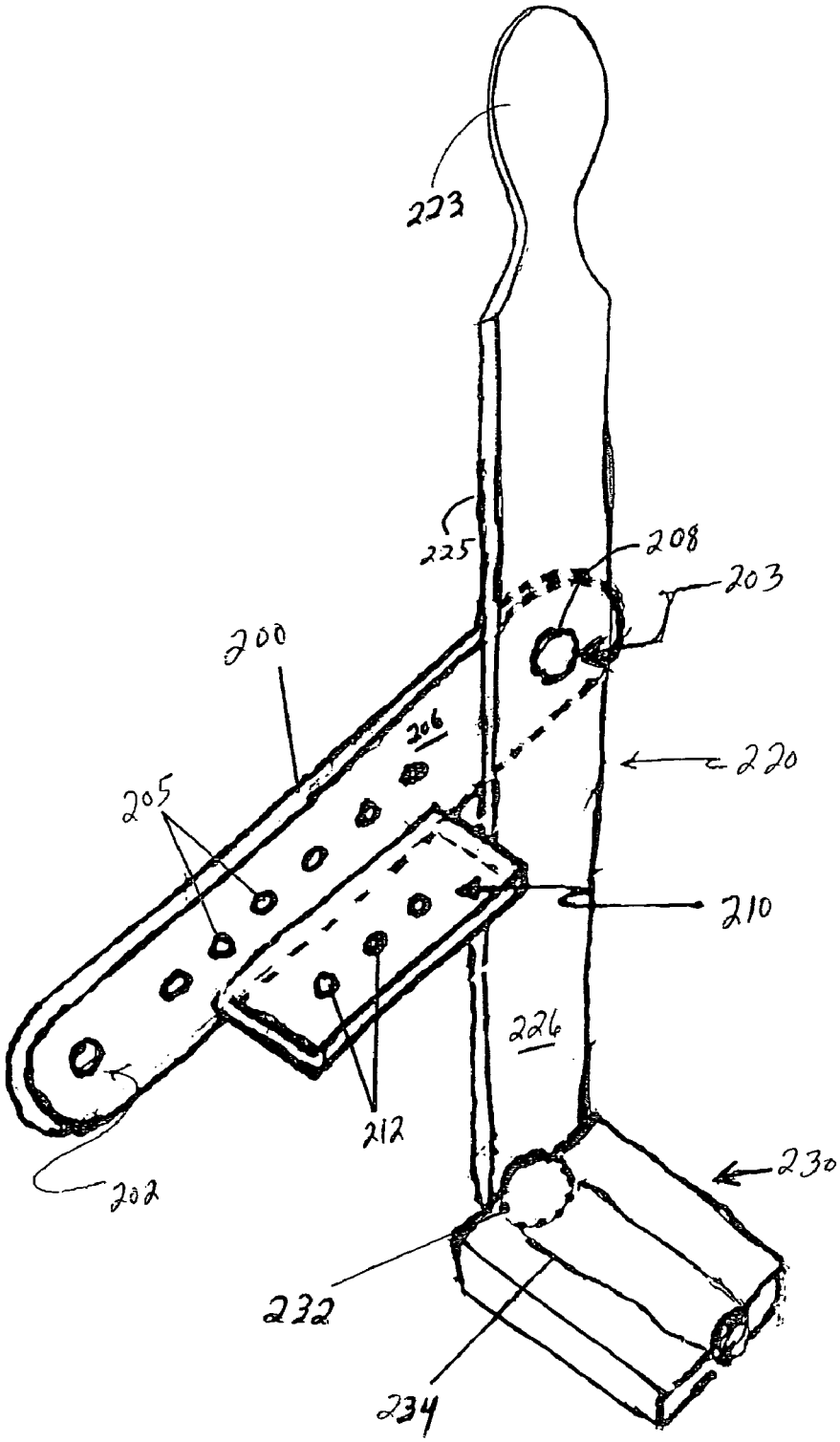
FIG. 7 illustrates a perspective view of the first alternate embodiment of the present invention.
Figure 8:
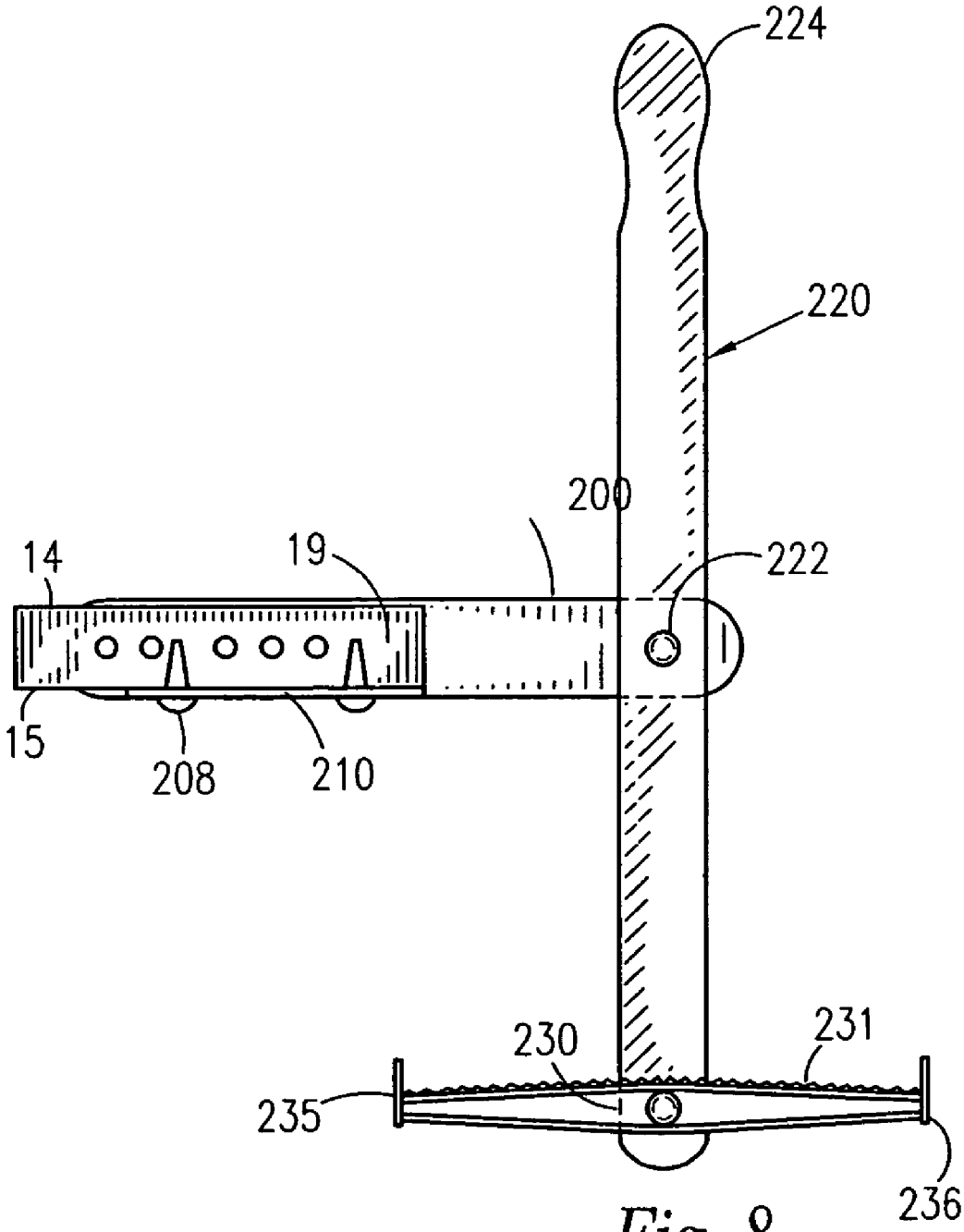
FIG. 8 is a side elevational view thereof shown mounted to a seat portion of a standard chair.

Referring now to FIGS. 7 & 8, a first alternate embodiment of the present invention is provided. The first alternate embodiment comprises a mounting bar 200 defining a linearly, elongated, prolate configuration. The mounting bar 200 includes arcuate, opposed ends each defining a fulcrum aperture 202, 203 adapted to permit rotational mounting of a lever 220 (to be described later in greater detail). Fulcrum apertures 202, 203, being formed at opposing ends of mounting bar 200, allow for alternative or selective positioning of lever 220.

The mounting bar 200 further defines a series of holes 205 linearly aligned in spaced relationship and adapted to permit mounting of mounting bar 200 to a lateral, vertical sidewall 19 of a seat portion 14 of a standard chair 12 using a fastener assembly 208.

The mounting bar 200 still further defines a mounting bracket 210 mounted perpendicularly atop a front side 206 of mounting bar 200, below and parallel to the series of holes 205 thereof. The mounting bracket 210 is of an elongated, generally rectangular configuration having a series of holes 212 linearly aligned in spaced relationship and adapted to permit mounting of mounting bar 200 to a bottom wall 15 of the seat portion 14 of the standard chair 12 using a fastener assembly 208.

The lever 220 defines a linearly, elongated, prolate configuration having arcuate, opposed ends. The lever 220 has a greater measurable length with respect to mounting bar 200. The lever 220 includes an aperture 222 formed near an upper portion thereof adapted to permit mounting of lever 220, via a fastener assembly 208, to the fulcrum aperture 202, 203 of a selected opposed end of the mounting bar 200. An upper bulbous portion 223 of lever 220 serves as a handle 224.

The lever 220 further includes a pedal 230 or foot-rest being rotatably mounted to a lower end thereof. A threaded aperture 232 is formed at lower end of lever 220 and is adapted to threadedly mount pedal 230. The pedal 230 is adapted to rotate about an axle 234. An end of axle 234 is provided with threads adapted to mate with the threaded aperture 232 formed at the lower end of lever 220. The pedal 230 projects perpendicularly from the front surface 226 of lever 220. An upper surface of pedal 230 is disposed with a cushiony pad 231. FIG. 8 illustrates a pedal **230*a* adapted with a heel brace 235 mounted vertically to a rearward end thereof. A forward end of pedal 230*a* includes a toe brace 236** mounted vertically thereto.

Once properly mounted to the seat portion 14 of a standard chair 12, the first alternate embodiment is utilized in the same manner for facilitating therapeutic rehabilitation as described hereinabove with respect to the preferred embodiment of the present invention.

Figure 9:
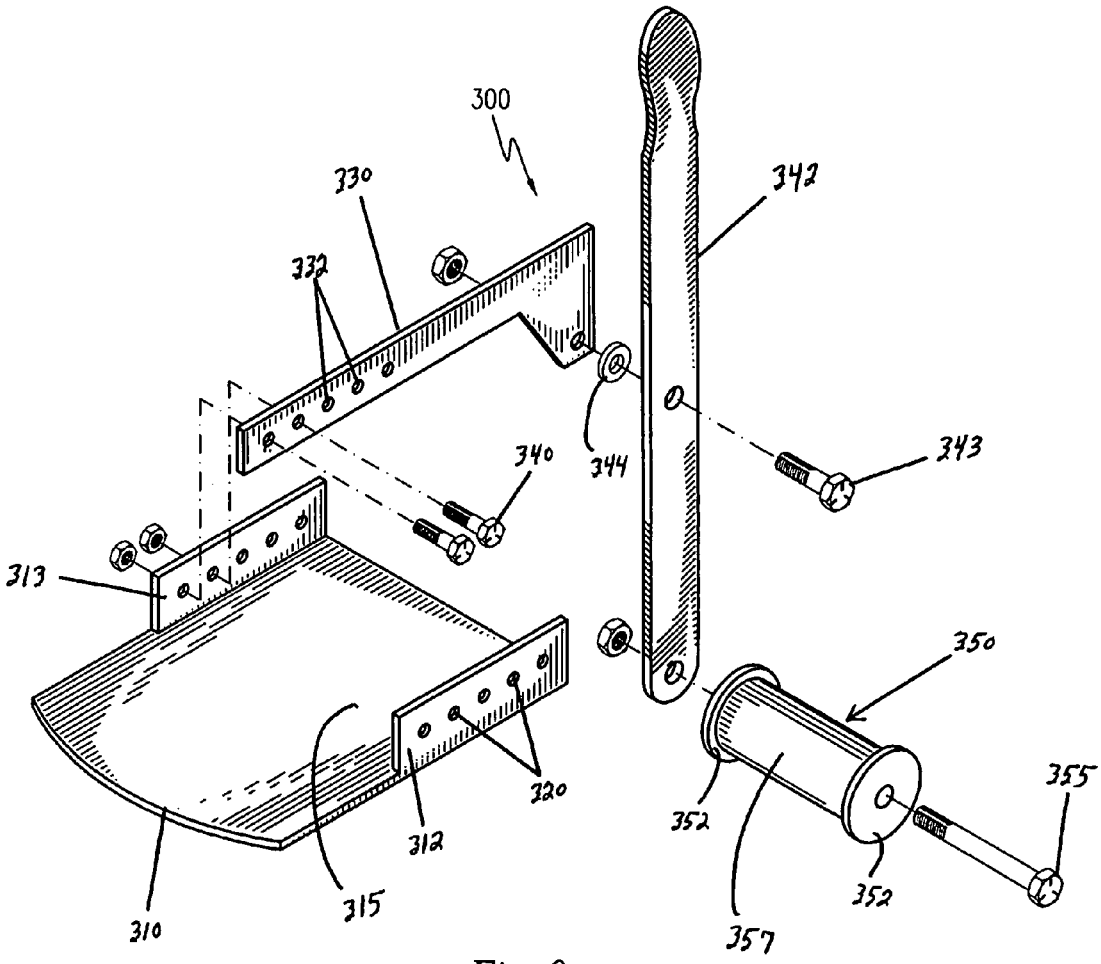
FIG. 9 illustrates an exploded perspective view of a second alternate embodiment of the present invention.

Referring now to FIG. 9, a second alternate embodiment of the present invention is shown. The second alternate embodiment presents a therapeutic rehabilitative device 300 adapted to be utilized with a standard chair or a standard wheelchair. The second alternate embodiment is designed and configured for placement atop the seat portion of a chair or wheelchair and then suitably mounted thereto in a manner to be described hereinbelow. The therapeutic rehabilitative device provides user with a means for providing physical therapy to a medically afflicted knee in a manner which is quick, easy, and efficient.

The therapeutic rehabilitative device 300 comprises a seat 310 having a pair of opposed flanges 312, 313, wherein flanges 312, 313 extend vertically in a perpendicular manner along outer edges of a glutei contacting portion 315 of seat 310. The flanges 312, 313 are further defined as having a linearly elongated configuration with a plurality of mounting holes 320 aligned in spaced relationship.

An elongated mounting bar 330 is provided for mounting to a selected flange 312, 313, wherein selection of flange 312, 313 being dependent upon user's desire to exercise a left or right knee. The elongated mounting bar 330 includes a series of holes 332 provided in spaced relationship and adapted to align in a corresponding manner with holes 320 of flange 312, 313 along an outer sidewall thereof, so as to permit mounting of elongated mounting bar 330 to flange 312, 313 via nut and bolt assembly 340, for example, U-bolts and nuts. The series of holes 332 of elongated mounting bar 330 and the plurality of mounting holes 320 are adapted to provide for selective linear adjustment in order to accommodate upper leg portions of users having differing lengths.

A lever 342 is pivotally mounted to a forward end of elongated mounting bar 330 via a fulcrum bolt and nut 343. A disc 344, fabricated of plastic, is mounted between lever 340 and elongated mounting bar 330 to facilitate frictionless pivot by lever 340. The function of lever 340 will be described in greater detail below.

In order to provide selectively-adjustable resistance, an ankle engagement element 350 is provided. The ankle engagement element 350 defines an elongated, circular configuration having flared ends 352, thus forming an object resembling a conventional spool. The ankle engagement element 350 is mounted to a lower end of lever 340 below fulcrum bolt and nut 342 via a fastener 355. In order to provide comfort when a forward ankle portion of user is engaged against ankle engagement element 350, the ankle engagement element 350 is encompassed with a cushiony material 357.

During operation, user sits atop the seat 310, engages and maintains contact by forward ankle portion with ankle engagement element 350, and with hand grasping lever 340, extends and curls leg in an adjustable-resistant manner, wherein resistance being operatively controlled by amount of force applied or lessened by manually-operated lever 340.

The design and configuration of the lever 340 and ankle engagement element 350 facilitate selectively-adjustable resistance by the user, so as to allow the engaged resistance to be increased or decreased at any time during a rehabilitation cycle according to user preference.

The therapeutic rehabilitative device 300 is constructed of materials which includes but is not limited to plastic, metal, and wood. It is envisioned that the therapeutic rehabilitative device 300 is adapted with a motor so as to facilitate automatic lifting and lowering of ankle engagement element 350.

Figure 10:
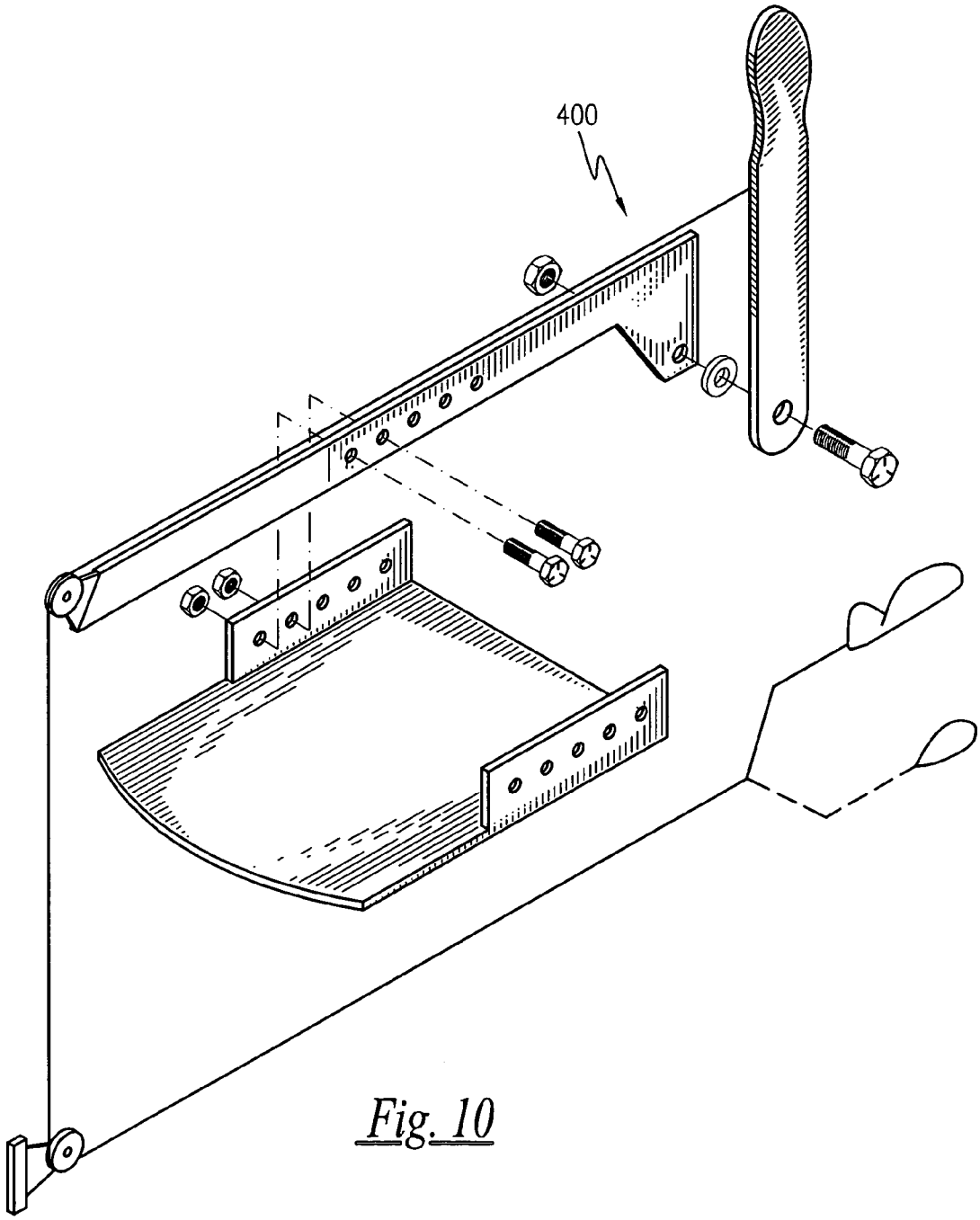
FIG. 10 illustrates an exploded perspective view of a third alternate embodiment of the present invention.

Referring now to FIG. 10, a third alternate embodiment is shown. The third alternate embodiment presents a therapeutic rehabilitative device 400 comprising a pulley system. The pulley system is adapted to facilitate selectively-adjustable resistance. The pulley system comprises a first pulley mounted atop a rearward end of elongated mounting bar. A second pulley is mounted to a forward wall of a cross bar lying in planar alignment with first pulley, wherein cross bar is horizontally mounted to back legs of a chair in a manner whereby cross bar traverses the chair legs. Alternatively, the cross bar is horizontally mounted to lower vertical support members of a standard chair or wheelchair in a manner whereby cross bar traverses the lower vertical support members.

An elongated cable is provided having a first end opposite a second end. The first end is provided with a clamp adapted for releasable connection to a lobe formed by a circular void integrally manufactured within an upper portion of lever. The first end of cable extends from the lever and is threaded over first pulley, and over second pulley, wherein the second end of cable attaches to an eyelet of a foot slipper or terminates into an ankle loop adapted to receive user's foot therethrough, wherein a forward ankle portion of user's foot is in taut engagement with ankle loop or slipper.

The design and configuration of the lever and pulley system facilitate selectively adjustable resistance, so as to allow the engaged resistance to be increased or decreased at any time during a rehabilitation cycle according to user preference.

Figure 11:
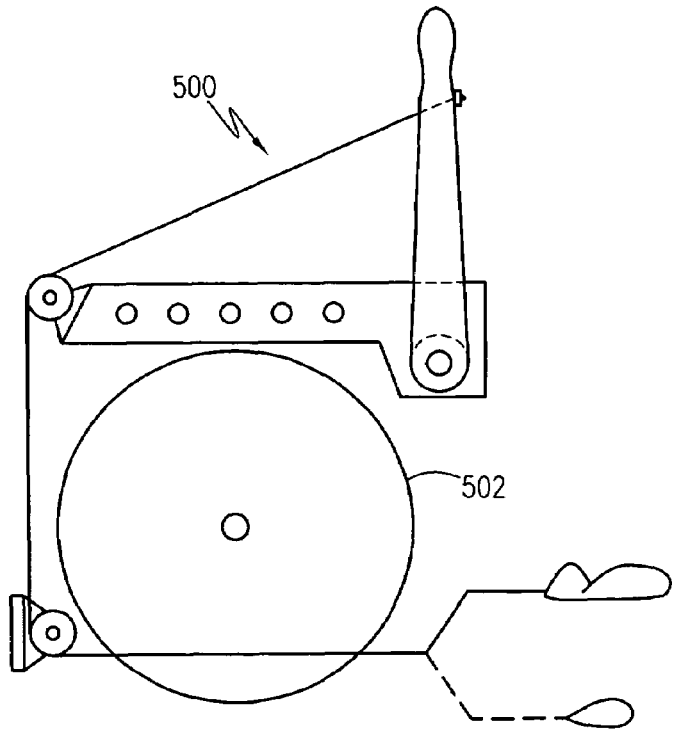
FIG. 11 illustrates a perspective view of a fourth alternate embodiment of the present invention.

Referring now to FIG. 11, a fourth alternate embodiment is shown. The fourth alternate embodiment provides a physical therapy treatment device 500 adapted for use with a standard wheel chair 502. This particular embodiment comprises an alternative, elongated mounting bar adapted for removable connection to an arm support member of a standard wheelchair, thus eliminating the need for a seat component. The fourth alternate embodiment includes a cross bar horizontally mounted to lower vertical support members of the standard wheelchair. The fourth alternate embodiment further comprises all remaining elements described hereinabove with regard to the second alternate embodiment and are incorporated herein for reference.

Figure 12:
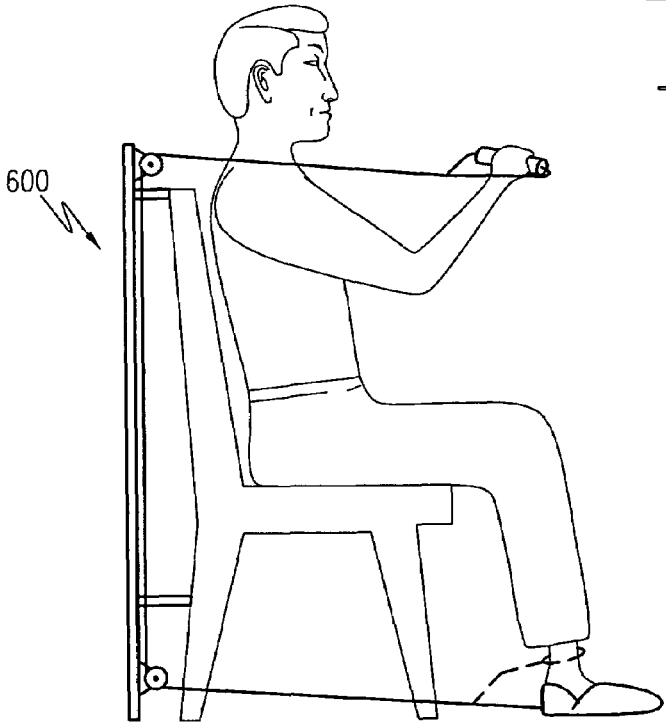
FIG. 12 illustrates a fifth alternate embodiment of the present invention shown in-use.

Finally, referring to FIG. 12, a fifth alternate embodiment is shown. The fifth alternate embodiment provides a physical therapy treatment device 600 adapted for use with a standard chair or wheelchair. The fifth alternate embodiment comprises an elongated, vertical member adapted for removable connection to a rear side of a lower end of a leg of the standard chair. The fifth alternate embodiment further comprises a pulley system defining a first pulley mounted to a forward side wall of elongated, vertical member, near an upper portion thereof. The pulley system further defines a second pulley mounted to the forward side wall of elongated, vertical member, near a lower portion thereof.

An elongated cable is provided having a first end opposite a second end. The first end is provided with a handle being suitably attached thereto. The second end is attached to a pull eyelet of a foot slipper or is provided with an ankle-receiving loop. The elongated cable extends from the handle and is threaded over first pulley and over second pulley.

2. Operation of the Preferred Embodiment

To use the present invention, user first properly engages the bracket 20 against an outer ledge portion 14*a* of the seat portion 14 of a standard chair 12. Next, user directs the free end 53 of flexible, elongated band 52 around the seat portion 14 of the standard chair 12, and over and around the outer surface of bracket 20 and fulcrum pin connector 30 such that the flexible, elongated band 52 is wrapped around the entire periphery of seat portion 14 of the standard chair 12 in a manner which surrounds and envelopes the seat portion 14. User couples the free end 53 of flexible, elongated band 52 to the tension means 55. User then tautens the flexible, elongated band 52 around seat portion 14 via handle 56 of the tension means 55, which in turn tightly secures bracket 20 in position. Next, user inserts the fulcrum pin 44 of lever 40 through the circular bore 32 of fulcrum pin connector 30, thereby rotationally mounting lever 40 to fulcrum pin connector 30.

In order to facilitate therapeutic rehabilitation through the performance of the "leg extension" movement, user sits atop the seat portion 14 of the standard chair 12, engages and maintains contact by user's rearward ankle portion or user's foot firmly in contact with pedal 70 or foot-rest, and with hand grasping handle 46 of lever 40, user extends and lowers accompanying leg while simultaneously pulling handle 46 of lever 40 backward in an adjustable-resistant, sequential manner, wherein resistance being operatively and appropriately controlled in a conjunctive manner by amount of force applied or lessened by user's manual operation of lever 40.

In order to facilitate therapeutic rehabilitation through the performance of the "leg curl" movement, user sits atop the seat portion 14 of the standard chair 12, engages and maintains contact by user's forward ankle portion or user's foot firmly in contact with pedal 70, and with hand grasping handle 46 of lever 40, user pushes lever 40 forward and bends accompanying leg downward and then extends leg in an adjustable-resistant, sequential manner, wherein resistance being operatively controlled in a conjunctive manner by amount of force applied or lessened by user's manual operation of lever 40.

The use of the present invention allows a therapeutic rehabilitative apparatus to be utilized with a standard chair or a standard wheelchair which facilitates selectively-adjustable resistance by the user, so as to allow the engaged resistance to be increased or decreased at any time during a rehabilitation cycle according to user preference.

Therefore, the foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be broadly limited only by the following Claims.

What is claimed is:

1. A therapeutic rehabilitative apparatus, said apparatus comprises:

a bracket defining a generally L-shaped configuration having a horizontal upper member integrally joined to a vertical member to form an inner cavity adapted to snugly receive the outer ledge portion of a chair, inner sidewalls comprised on said horizontal and said vertical members form a seat portion engagement surface that snugly envelops said outer ledge portion;

a tightener mechanism adapted to snugly secure said bracket against said outer ledge portion;

a fulcrum pin connector mounted to said bracket; and a lever rotationally mounted to said fulcrum pin connector, said fulcrum pin connector provides a fulcrum about which said lever rotates;

wherein said fulcrum pin connector is mounted to a lower end comprised on said vertical member, said fulcrum pin connector includes a circular bore through which said fulcrum pin of said lever is inserted, said circular bore is adapted with a bearing to facilitate frictionless rotation by said fulcrum pin.

2. The therapeutic rehabilitative apparatus of claim 1, wherein said tightener mechanism comprises a flexible, elongated band having a free end which is directed around said seat portion of said standard chair and over and around an outer surface of said bracket and said fulcrum pin connector after proper engagement of said bracket against said outer ledge portion of said seat portion of said standard chair.

3. The therapeutic rehabilitative apparatus of claim 2, wherein said flexible, elongated band is wrapped around an entire periphery of said seat portion of said standard chair in a manner so as to surround and envelope said seat portion, said flexible, elongated band is tautened around said seat portion via a tension means, said free end of said flexible, elongated band is removably coupled to said tension means, wherein said tension means is also connected to an opposing end of said flexible, elongated band.

4. The therapeutic rehabilitative apparatus of claim 3, wherein said tension means includes a handle adapted to provide ratchet action upon pivotal reciprocation thereof so as to allow for said flexible, elongated band to be tightened around said seat portion, and which in turn, tightly secures said bracket in position.

5. The therapeutic rehabilitative apparatus of claim 4, wherein said tension means includes a tension release mechanism adapted to relax said flexible, elongated band in order to facilitate easy removal of said flexible, elongated band from the seat portion.

6. The therapeutic rehabilitative apparatus of claim 5 further comprises:

an aperture formed on the anterior end of an elongated member of said lever, said aperture is provided as a means to perpendicularly mount said handle via a fastener, said handle projects perpendicularly from the front surface of said elongated member; and a pedal formed on the posterior end of said elongated member;

wherein said pedal is adapted to rotate about an axle, said axle includes an end provided with threads adapted to mate with a threaded aperture formed at said posterior end of said elongated member of said lever, said pedal projects perpendicularly from the rear surface of said elongated member.

7. The therapeutic rehabilitative apparatus of claim 6, wherein said fulcrum pin is mounted approximately intermediate to said handle and said pedal, said fulcrum pin projects perpendicularly from the front surface of said elongated member.

8. The therapeutic rehabilitative apparatus of claim 7, wherein said fulcrum pin is provided with a detent for holding said fulcrum pin in rotational connection with said circular bore.

9. The therapeutic rehabilitative apparatus of claim 7, wherein said fulcrum pin is provided within aperture extending therethrough for accepting a cotter pin for holding said fulcrum pin in rotational connection within said circular bore.

10. A therapeutic rehabilitative apparatus comprising:

a mounting bar, said mounting bar defines a linearly, elongated, prolate configuration, said mounting bar includes arcuate, opposed ends each defining a fulcrum aperture, said mounting bar defines a series of holes linearly aligned in spaced relationship and adapted to permit mounting of said mounting bar to a lateral, vertical sidewall of a seat portion of a standard chair using a fastener assembly, and wherein said mounting bar includes a mounting bracket mounted perpendicularly atop a front side of said mounting bar, below and parallel to said series of holes, said mounting bracket is of an elongated, generally rectangular configuration having a series of holes linearly aligned in said spaced relationship and adapted to permit mounting of said mounting bar to a bottom wall of the seat portion of the standard chair using a fastener assembly; and a lever, said lever defines a linearly, elongated, prolate configuration having arcuate, opposed ends, said lever has a greater measurable length with respect to said mounting bar, said lever includes an aperture formed near an upper portion thereof adapted to permit mounting of said lever, via a fastener assembly, to said fulcrum aperture of a selected arcuate, opposed end of and mounting bar, and wherein said lever defines an upper bulbous portion which serves as a handle.

11. The therapeutic rehabilitative apparatus of claim 10, wherein said lever includes a pedal being rotatably mounted to a lower end of said lever, said pedal has an upper surface disposed with a cushiony pad, and wherein said pedal has a rearward end which includes a heel brace, and wherein said pedal has a forward end which includes a toe brace mounted vertically thereto along an elongated centerline of said toe brace.

12. A therapeutic rehabilitative apparatus comprising:

a seat, said seat is adapted to be utilized with a standard chair or a standard wheelchair, wherein said seat is adapted for placement atop a seat portion fo the standard chair or standard wheelchair and then suitably mounted thereto, said seat having a pair of opposed flanges, wherein said flanges extend vertically in a perpendicular manner along outer edges of a glutei contacting portion of said seat, said flanges further comprise a linearly elongated configuration with a plurality of mounting holes aligned in spaced relationship;

an elongated mounting bar, said elongated mounting bar is mounted to a selected flange of said flanges, said elongated mounted bar includes a series of holes provided in spaced relationship and adapted to align in a corresponding manner with said mounting holes of said selected flange along an outer sidewall thereof, so as to permit mounting of said elongated mounting bar to said selected flange nut and bolt assembly;

a lever, said lever is pivotally mounted to a forward end of said elongated mounting bar via a fulcrum bolt and nut;

a disc, said disc is mounted between said lever and said elongated mounting bar to facilitate frictionless pivot by said lever; and an ankle engagement element, said ankle engagement element defines an elongated, circular configuration having flared ends, said ankle engagement element is mounted to a lower end of said lever below said fulcrum bolt via a fastener, and wherein said therapeutic rehabilitative apparatus facilitates selectively-adjustable resistance by a user, so as to allow engaged resistance to be increased or decreased at any time during a rehabilitation cycle according to user preference.

* * * * *